US005101912A

United States Patent [19]

Smet

[11] Patent Number: 5,101,912

[45] Date of Patent: Apr. 7, 1992

[54] STEERABLE GROUND DRILLING DEVICES

[76] Inventor: Marc Smet, Kasteelstraat 29, 2400 Mol, Belgium

[21] Appl. No.: 641,283

[22] Filed: Jan. 15, 1991

[30] Foreign Application Priority Data

Jan. 15, 1990 [BE] Belgium ..... 9000052

[51] Int. Cl.[5] ..... E21B 7/06

[52] U.S. Cl. ..... 175/26; 175/73

[58] Field of Search ..... 175/21, 24, 26, 27, 175/45, 61, 73

[56] References Cited

U.S. PATENT DOCUMENTS

| | | | |
|---|---|---|---|
| 2,712,434 | 7/1955 | Giles et al. | 175/73 X |
| 4,040,495 | 8/1977 | Kellner et al. | 175/73 |
| 4,632,191 | 12/1986 | McDonald et al. | 175/26 X |
| 4,770,258 | 9/1988 | Falgout, Sr. | 175/73 |
| 4,921,055 | 5/1990 | Kayes | 175/45 |

FOREIGN PATENT DOCUMENTS

| | | | |
|---|---|---|---|
| 1122965 | 5/1982 | Canada | 175/73 |
| 130011 | 3/1960 | U.S.S.R. | 175/73 |

*Primary Examiner*—William P. Neuder

*Attorney, Agent, or Firm*—Foley & Lardner

[57] ABSTRACT

Steerable ground drilling device, which comprises a body (3) destined to be attached to a flexible pipe, a rotatable head (4) which is mounted on the front extremity of the body (3) and is provided with at least one spraying device or hammer drill (5) to which fluid under pressure can be supplied through a pipe (10 through 13) which extends through the head (4) and the body (3), and means (6) for rotating the head (4), characterized in that the means (6) for rotating the head (4) are means which can rotate this head (4) both in one direction and in the other direction and that, between the head (4) and the body (3), an axially located shaft section (7) is mounted that is attached to the head (4) and through which extends the pipe (10 through 13) for the supply of fluid under pressure to the spraying device (5), a cylinder (14) which surrounds the shaft section (7) and comprises an outer periphery which is eccentric in relation to the shaft section (7), and a blocking mechanism (15) is mounted that can couple the cylinder (14) to the shaft section (7) or can release it from the shaft section (7).

13 Claims, 1 Drawing Sheet

STEERABLE GROUND DRILLING DEVICES

BACKGROUND OF THE INVENTION

1. Field of the Invention

The invention relates to a steerable ground drilling device, which comprises a body destined to be attached to a flexible pipe, a rotatable head which is mounted on the front extremity of the body and is provided with at least one spraying device to which fluid under pressure can be supplied through a pipe which extends through the head and the body and means for rotating the head.

2. Discussion of the Related Art

Such steerable ground drilling devices are especially utilized for making for tunnels in the ground into which the laying of so-called public utilities, such as cables and such and the like, is accomplished.

The steering of the ground drilling device can occur in various ways.

It is known to attach the head of the steerable ground drilling device to the body by means of a ball and socket joint, such that it can be fitted in relation to the body.

It is also known to provide the head with a guidable spraying device and to alter the spraying direction of the spraying device if required.

In yet another known ground drilling device the spraying device or a hammer drill is directed asymmetrically in relation to the axis of the body.

With continual rotation, the drilling device will move straight forward. With a stationary head the spraying is asymmetric and the drilling device will alter direction if it is pressed further rotatingly or hammered rotatingly.

With all these ground drilling devices the head must be stationary with alteration of direction.

Ground drilling devices are known whereby the head can rotating, even during the alteration of direction. In this way ground drilling devices are known whereby laterally directed spraying devices are provided in the body in order during the alteration of direction, to press the body away from the wall of the already formed opening.

All these known ground drilling devices are, however, relatively complicated and the steering of them is not easy.

SUMMARY OF THE INVENTION

The purpose of the invention is to remedy these disadvantages and to provide a steerable ground drilling device which is reliable and simply constructed, and whereby the head can also rotate during the alteration of direction.

For this purpose, the means for rotating the head can rotate this head both in one direction and in the other direction, and between the head and the body an axially located shaft section is mounted that is attached to the head and through which extends the pipe for the supply of fluid under pressure to the spraying device, a cylinder which surrounds the shaft section and which comprises an outer periphery which is eccentric in relation to the shaft section and a blocking mechanism that can couple the cylinder to the shaft section or can release it from the shaft section.

The ground drilling device is of the type whereby during the drilling, head is continually rotated. It is clear that, when the cylinder is coupled to the rotating head, the ground drilling device, notwithstanding the eccentric periphery of the cylinder, will still move straight forward in the ground through the continual rotation of this cylinder. When the cylinder, on the other hand, is loose from the head then this cylinder will, through the resistance which it experiences in the ground, not rotate along with the head. Because of the fact that the periphery of the cylinder is eccentric this cylinder will press away with the part situated farthest to the outside in relation to the ground and the ground drilling device will deviate from the straight line in a direction which is opposite to the location of the part of the cylinder situated farthest to the outside.

Although the blocking mechanism can be a directly controllable mechanism, for example can comprise an electromagnetically operated coupling pin, it is preferable that this mechanism needs no special control and the coupling or uncoupling takes place without direct action on the blocking mechanism, although obviously the engagement or disengagement of the coupling mechanism must be able to be commanded.

In a particular embodiment of the invention the blocking mechanism is therefore a ratchet mechanism that, with rotation of the shaft section and the head in one direction, drives the cylinder, but with rotation of the shaft section and the head in the other direction, allows the cylinder to remain stationary.

The engagement, respectively the release, of the cylinder in relation to the shaft section can simply depend upon the resistance which the cylinder experiences in the ground.

The ratchet mechanism can however be so constructed that even with a great resistance of the cylinder in the ground this cylinder is still driven by the shaft section in one direction of rotation, while with rotation in the other direction the cylinder already with a small resistance in the ground remains stationary in relation to the head.

The aforementioned ratchet mechanism suitably comprises a disk which is attached to the shaft section and on its edge is provided with at least one notch, a ratchet which is mounted radially movable but almost not axially slidable on the inside of the cylinder and can penetrate into the notch and an elastic device that presses the ratchet into the notch.

With sufficient force the ratchet can be pressed out of the notch through elastic transformation of the elastic element. The form of the notch can be so adapted that, when the cylinder is slowed down, the jumping out of the ratchet out of the notch occurs more easily with rotation of the shaft section in one direction than with rotation of this shaft section in the other direction.

In a noteworthy embodiment of the invention, the eccentricity of the cylinder originates because of the fact that it is provided on its outer periphery with an axially directed rib.

Other details and advantages of the invention will appear from the following description of a steerable ground drilling device according to the invention, with reference to the enclosed drawings, in which:

DETAILED DESCRIPTION OF THE PREFERRED EMBODIMENT

Figure 1:
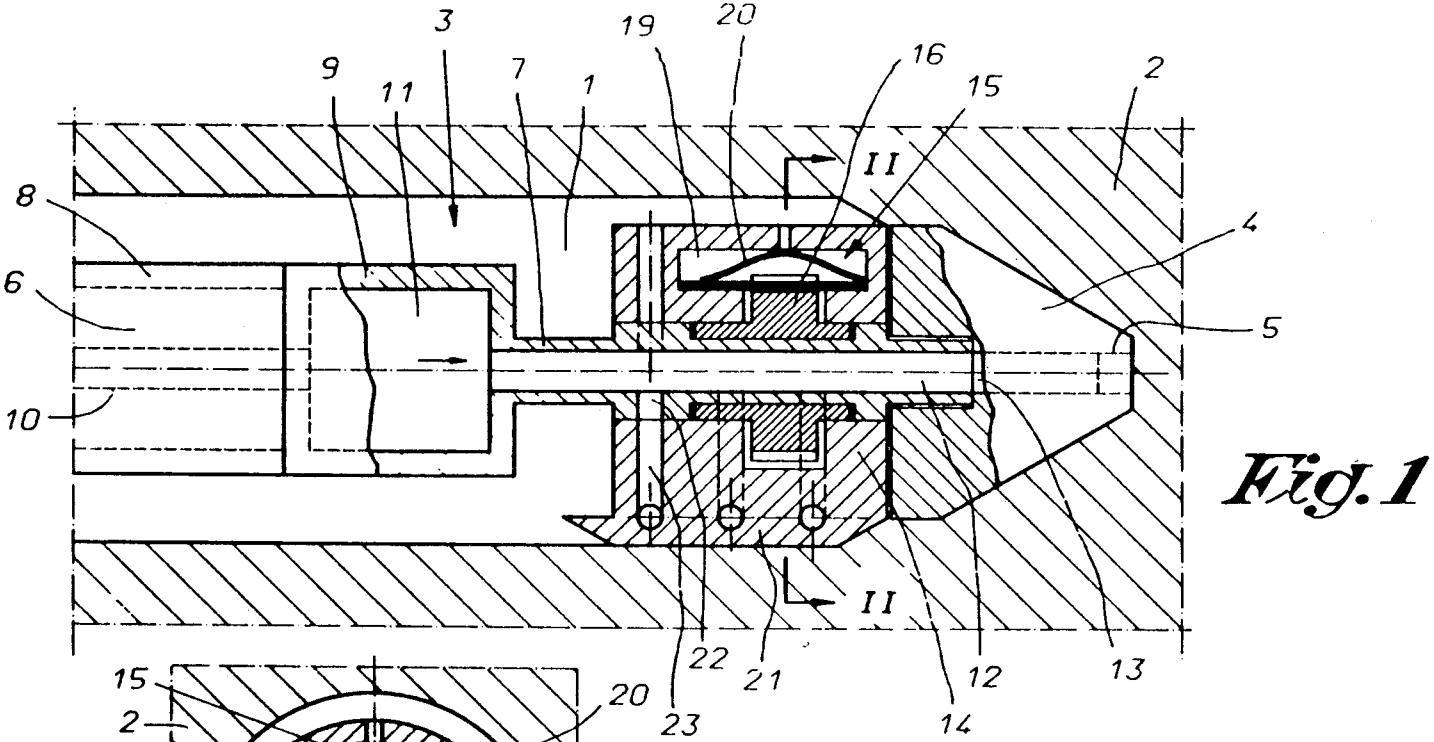
FIG. 1 shows a longitudinal section of a steerable ground drilling device according to the invention, during the drilling of a tunnel in the ground.

The steerable ground drilling device, for drilling a tunnel 1 in the ground 2, principally comprises a body 3, a head 4 mounted on the front extremity thereof which in this embodiment is provided with a spraying device 5, and a hydraulic motor 6 for the rotation of the head 4.

The body 3 is attached to a pipe (not shown in the figures) which is sufficiently strong to push the ground drilling device forward into the ground, or to pull it out of the tunnel 1, but still supple enough to allow alterations of direction of the ground drilling device. The pipe also forms a passage for the liquid under pressure for the motor 6 and the spraying device 5.

The body 3 is connected to the head 4 by means of a shaft section 7 that extends along to the longitudinal axis of the body 3, and therefore of the complete ground drilling device. The shaft section 7 is, on the one hand, attached to the, possibly replaceable, head 4 and is, on the other hand, attached to the shaft of the motor 6 mounted in the body 3.

The body 3 can be rotatable in its entirety in relation to the aforementioned pipe, in which case the shaft section 7 is attached to the body 3. The body 3 can also, except for the shaft of the motor 6, be completely attached in relation to the aforementioned pipe, in which case the shaft section is mounted on bearings in the body 3 and is only attached to the shaft of the motor 6 mounted in the body 3.

Figure 2:
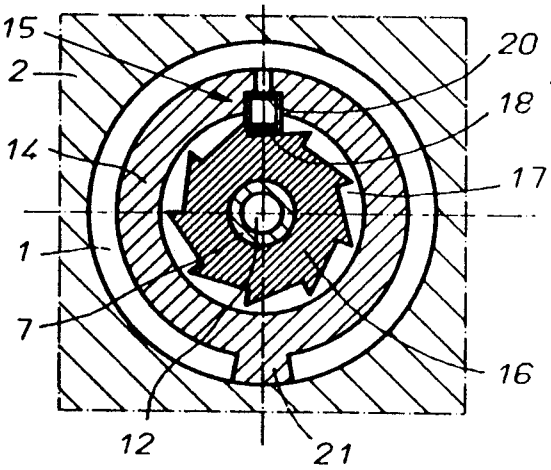
FIG. 2 shows a cross section according to line II—II in FIG. 1.

The body 3 can also, as shown in FIGS. 1, 2, consist of a fixed part 8 and a rotatable part 9. The fixed part 8 is attached to the aforementioned pipe and surrounds the motor 6. This part 8 can possibly form the housing of the motor 6 itself. The rotatable part 9 is attached to the shaft of the motor 6 and secured to the shaft section 7.

The supply of the liquid under pressure, via the aforementioned pipe, to the spraying device 5 occurs through a channel 10 through the motor 6, the inner space 11 of the hollow rotatable part 9 of the body 3, a channel 12 in the shaft section 7 and channel 13 in the head 4.

Between the body 3 and the head 4 the shaft section 7 is surrounded by a cylinder (bushing) 14 which by means of a ratchet mechanism 15 can be coupled to the shaft section 7.

This ratchet mechanism 15 comprises a disk 16 which is immovably secured to the shaft section 7 and which is provided with notches 17 equally spaced over its periphery. The notches 17 have, as especially appears from FIG. 2, such a shape that between the notches saw tooth shaped teeth are formed.

The ratchet mechanism 15 furthermore comprises a small slat 18 that forms a ratchet and that is mounted radially slidable but axially not slidable in a notch 19 which is applied in the wall of the cylinder 14 and which exits on the inside of the cylinder 14, at the location of the disk 16. This disk 16 therefore presses into the notch 19 whereby the small slat 18 in one position is situated in one of the notches 17 and in another position is situated entirely outside these notches 17.

In the first position the small slat 18 is pressed by a leaf spring 20 which is also disposed in the notch 19.

When the cylinder 14 is restrained with sufficient force, while the head 4 and the shaft section 7 rotate, the small slat 18 will, against the action of the leaf spring 20, jump out of the notch 17 in which it was pressed. Because of this, the cylinder 14 will remain stationary and the shaft section 7 will rotate inside cylinder 14.

It is clear that through the form of the notches 17, the small slat 18 is more easily pressed out of the corresponding notch 17 when the shaft section 7 rotates in one direction, namely in an anticlockwise direction as shown in FIG. 2, than in the other direction.

This therefore means that with rotation of the head 4 and the shaft section 7 in the direction, the cylinder 14 is normally engaged and therefore also rotates. When the head 4 and the shaft section 7 are rotated in the opposite direction, with the slightest resistance which the cylinder 14 experiences, the cylinder 14 will remain stationary. The motor 6 is obviously constructed so that it can switch direction of rotation, the stiching which can be commanded from above the ground, as for example by the operation of solenoid valves.

The cylinder 14 is provided with a rib 21 on its outer periphery which extends parallel to the shaft. The rib 21 forms a type of knife that slightly widens the tunnel 1 which is formed by the head. When the cylinder 14 rotates along with the head 4, a tunnel 1 is therefore dug with a diameter equal to twice the distance from the outer edge of the rib 21 to the geometric axis of the cylinder 14. When the cylinder on the other hand remains stationary, and only the head 4 rotates with the shaft section 7, the cylinder 14 will be pressed away from the wall of the tunnel 1 in the opposite direction to the rib 21. Because of the rib 21, the cylinder 14 is asymmetric. The rib 21 forms a type of deflective device.

The entire drilling device therefore alters direction and, when the drilling device has taken up the desired altered direction, the direction of rotation of the motor 6 is again switched so that the cylinder will again rotate with the head 4.

In order to facilitate the removal of loosened ground, radially directed channels 22 connect to the channel 12 of the shaft section 7. Radially directed channels 23 also extend straight through the cylinder 14. Each time the small slat 18 is in a notch 17 at least a number of channels 22 and 23 are situated opposite each other so that a fluid under pressure radially flows out of the cylinder 14, via the channels 22 and 23, and carries along loosened ground through the already formed tunnel 1.

It is preferable that the tunnel drilling device is provided with means for detecting the position and, for example, also for detecting the direction of the drilling device in the ground, so that an accurate steering of the drilling device is possible.

The alteration of the drilling direction of the ground drilling device described above can be performed in a very simple manner.

The present invention is in no way restricted to the embodiment described above, and within the scope of the patent application many changes can be applied to the described embodiment.

In particular, the motor need not necessarily be a hydraulic motor. It can also be an electric motor or an air motor such that the direction of rotation thereof can be switched.

Furthermore the head can also have more than one spraying device.

Likewise the spraying device 5 can be replaced by a hammer drill. The form of the notches in the disk of the ratchet mechanism need not necessarily be as represented and described. The disk need not for that matter be provided with notches over its entire periphery. One notch is sufficient, but in that case, the cylinder can obviously only be blocked in one side in relation to the shaft section 7. The notch can also be so large that only one side remains.

The ratchet need not necessarily be a small slat This ratchet can also be formed by a ball or a hinging finger.

I claim:

1. A steerable ground drilling device comprising:

a body (3) having a longitudinal axis;

a head (4), coaxially alligned with said body and rotatable in first and second directions, having a boring device (5) capable of boring in both of said directions;

a shaft section (7) connecting said heat (4) to said body (3) and being fixed with respect to said head (4), said shaft section (7) being coaxially aligned with said head (4) and said body (3);

means (6) for rotating said head (4) and said shaft section (7) in said directions:

a bushing (14) rotatably mounted around said shaft section (7) between said head (4) and said body (3), and adjacent to said head (4), said bushing (14) having on its outer periphery a drilling edge (21) extending parallel to said shaft section (7) and forming an eccentricity protruding laterally outside the largest diameter of said head (4); and a blocking mechanism (15) for blocking, during said first rotation direction of said shaft section (7), the bushing (14) in one of a plurality of stationary positions relative to said shaft section (7), and for releasing said bushing (14) from said stationary position by rotating said shaft section (7) in said second direction, wherein said stationary positions are situated around said shaft section (7).

2. Steerable ground drilling device according to claim 1, wherein the blocking mechanism (15) is a ratchet mechanism that, with rotation of the shaft section (7) and the head (4) in said second direction, drives the bushing (14), but with rotation of the shaft section (7) and the head (4) in the first direction, allows the bushing (14) to remain stationary.

3. Steerable ground drilling device according to claim 2, wherein the driving, and release of the bushing (14) in relation to the shaft section (7) depends upon the resistance the cylinder (14) experiences in the ground.

4. Steerable ground drilling device according to claim 3, wherein the ratchet mechanism (15) is constructed so that even when there is great resistance of the cylinder (14) in the ground (2), the bushing (14) is driven by the shaft section (7) in said second direction, while when the shaft section rotates in the first direction, the bushing (14) experiences a small resistance in the ground (2) and remains stationary in relation to the head (4).

5. Steerable ground drilling device according to claim 2, wherein the ratchet mechanism (15) comprises a disk (16) attached to the shaft section (7) and having on its edge at least one notch (17); a ratchet (18) mounted radially movable but essentially not axially slidable on the inside of the bushing (14), said ratchet (18) capable of penetrating into the notch (17); and an elastic device (20) that presses the ratchet (18) into the notch (17).

6. Steerable ground drilling device according to claim 5, wherein the elastic device (2) is a leaf spring which is disposed in the bushing (14).

7. Steerable ground drilling device according to claim 5, wherein the disk (16) is provided with several notches (17).

8. Steerable ground drilling device according to claim 7, wherein the notches (17) are formed such that teeth exist between the notches.

9. Steerable ground drilling device according to claim 5, wherein said bushing (14) has a notch (19) therein, said ratchet (18) is a small slat (18) extending parallel to the axis of said bushing (14) in said notch (19), and said disk (16) penetrates into said notch (19) so that said elastic device (20) can press the small slat (18) into said notch (17).

10. Steerable ground drilling device according to claim 1, wherein said drilling edge (21) is a rib.

11. Steerable ground drilling device according to claim 1, wherein said head (4), said shaft section (7) and said body (3) each have a passageway (12,11,13) therein which define a continuous passageway through which pressurized liquid flows.

12. Steerable ground drilling device according to claim 1, wherein said boring device (5) is a spraying device.

13. Steerable ground drilling device according to claim 1, wherein said boring device (5) is a hammer drill.

* * * * *